United States Patent [19]

Rittmannsberger et al.

[11] 3,949,717

[45] Apr. 13, 1976

[54] PRESSURE REDUCTION LIMITER IN A COMBUSTION ENGINE

[75] Inventors: Norbert Rittmannsberger, Stuttgart; Hermann Hoelle, Sonthofen; Klaus Bertsch, Backnang, all of Germany

[73] Assignee: Robert Bosch G.m.b.H., Stuttgart, Germany

[22] Filed: Oct. 11, 1972

[21] Appl. No.: 296,536

[30] Foreign Application Priority Data

Oct. 22, 1971 Germany ..... 2152586

[52] U.S. Cl... 123/119 D; 123/119 DB; 123/32 EA; 123/97 B; 251/61

[51] Int. Cl.[2] ..... F02B 32/00; F02B 3/00

[58] Field of Search..... 123/119 D, 119 DB, 97 B, 123/32 EA; 251/61

[56] References Cited

UNITED STATES PATENTS

| | | | |
|---|---|---|---|
| 1,145,671 | 7/1915 | Butcher | 251/61.5 |
| 1,171,695 | 2/1916 | Brady | 251/61.5 |
| 3,203,410 | 8/1965 | Scholl | 123/32 EA |
| 3,503,594 | 3/1970 | Goto | 123/97 B |
| 3,561,412 | 2/1971 | Yagi | 123/119 DB |
| 3,661,131 | 5/1972 | Croft | 123/97 B |
| 3,675,632 | 7/1972 | Nakajima | 123/119 D |
| 3,702,603 | 11/1972 | Boxendale | 123/97 B |
| 3,707,954 | 1/1973 | Nakada | 123/117 A |

FOREIGN PATENTS OR APPLICATIONS

| | | | |
|---|---|---|---|
| 471,966 | 6/1969 | Germany | 123/97 B |

*Primary Examiner*—Charles J. Myhre
*Assistant Examiner*—Ronald B. Cox
*Attorney, Agent, or Firm*—Michael J. Striker

[57] ABSTRACT

The air pressure in the intake valve undergoes a sudden decrease upon closure of the throttle valve. This decrease is sensed and opens a bypass which furnishes some air to the air intake means when the throttle is fully closed. The quantity of air so furnished is sufficient to allow combustion in all cylinders of the engine, thereby preventing excessive cooling.

12 Claims, 3 Drawing Figures

PRESSURE REDUCTION LIMITER IN A COMBUSTION ENGINE

BACKGROUND OF THE INVENTION

This invention relates to combustion engines and more particularly to electrically controlled intermittently operative injection arrangements having at least one injection means which is operated synchronously with the cam shaft rotations and which furnishes a quantity of fuel during each operating cycle of the machine which depends upon the pressure or volume of air in the intake means following the throttle valve in the direction of air flow through said air intake means. Generally, the injection valve is kept open for a period of time depending on said air pressure or volume, the fuel being furnished at a constant pressure. Further, in combustion engines of the type under discussion, there is an arrangement for controlling the engine during free running conditions.

In known fuel injection arrangements, when the engine is in a free running position, that is when the engine speed is substantially above the idling speed even in the presence of a closed throttle valve, a disconnecting arrangement is provided which either prevents the generation of electrical opening pulses for the injection means or else prevents said electrical opening pulses from reaching a power amplifier state immediately preceeding the solenoid valves which perform the injection. In these known systems, injection is prevented until the engine speed is no longer above the idling speed by a predetermined margin. Since no fuel is injected, of course, no harmful exhaust gases can be emitted. However, it has been found to be very disadvantageous that the exhaust system undergoes a very substantial cooling during this period. Thus, not only can a considerable power loss occur in any subsequent acceleration process, but also a great increase in the number of harmful gases emitted by the engine can occur.

SUMMARY OF THE INVENTION

It is an object of the present invention to furnish a pressure reduction limiting control which responds to the sudden pressure decrease in the intake means of the engine upon closure of the throttle valve by bypassing said throttle valve and allowing a limited quantity of air to reach the injection system. Thus in a free running mode of operation, sufficient combustion at sufficiently high combustion energy takes place in the individual cylinders to prevent the above-mentioned cooling of the exhaust system.

The pressure reduction limiter in accordance with the present invention has a housing which is divided into a first and second chamber by means of a membrane which is put under tension by a spring. First connecting means connects the first chamber to the air intake means following the throttle valve in the direction of air flow through the air intake means, while second connecting means connects said first chamber to said air intake means before said throttle valve in said direction of said air flow. Sealing valve means are wedged against said membrane means and serve to close said second connecting means when in the closed position. Finally, third connecting means connect said second chamber to said air intake means, said third connecting means including a choke bush which is situated within a connecting piece of the housing.

It has been noted that when the speed of the engine decreases the pressure reduction limiter is subject to oscillations, resulting from the large pressure variations within the air intake means. These oscillations cause the sealing valve to change periodically the quantity of air bypassing the throttle valve and therefore cause a very uneven operation of the engine. In accordance with a second embodiment of the present invention, these oscillations may be suppressed by furnishing a stiff partition in the first chamber between the sealing valve and the membrane, said stiff partition having a narrow passage for allowing changes in the air volume in the space between the partition and the membrane, said changes occurring upon movement of said membrane. The manufacture of the present limiter can be considerably simplified and a reliable sealing effect achieved, if the sealing valve has the shape of a plate and has a sealing surface which sits on the front end of a pipe terminating in said first chamber. The pipe having the end piece which makes contact with the sealing surface of the valve may be inserted into a further pipe which connects the first chamber with the air intake means behind the throttle valve in the direction of air flow. In order to achieve a membrane requiring little power for resetting and having a high accuracy of response, the membrane can be made of a webbing which has sheets of rubber on both sides. If the housing is made of two units, the membrane is then affixed at the edge between said two units together with the above-mentioned stiff partition.

In a preferred embodiment of the present invention a central metallic reinforcement disc is provided in the membrane, the spring causing the tension in said membrane being rested against a ring collar connected to said reinforcement disc. Further, the side of the reinforcement disc which faces the first chamber can serve as an abutment for a pressure pin whose other end is pushed against the sealing valve without play. The pressure pin may be moved in the length-wise direction thereof within a bore in the rigid partition. This bore, which serves to guide the movement of the pressure pin, may be within a synthetic collar which has been sprayed into or pressed into a central hole in the rigid partition. In this case the synthetic collar may also have a second, narrower bore, which serves as a throttling passage for the air. When, as described above, the sealing of the sealing valve takes place at the end surface of a pipe extending into the first chamber, a further simplification in the construction can be achieved if a reset spring surrounds said pipe, said reset spring being operative to push said sealing valve into an open position. In this way a position free of play of the pressure pin between the sealing valve and the membrane or its reinforcement plate is also assured.

A means of adjustment for adjusting the pressure drop to which the pressure reduction limiter of the present invention is responsive must also be furnished. Thus it becomes necessary to be able to adjust the tension applied by spring to the membrane. This can be achieved as follows: A threaded rod may be provided which may be threaded into the second chamber of the housing. The end portion of said threaded rod which extends into said chamber may be used as an abutment for the spring exerting tension in the membrane. A length-wise bore can extend through said threaded rod, and the end portion of said threaded rod which extends outside of said chamber can have a connecting piece for affixing a hose or a pipe. This hose or pipe is than connected to the air intake means. Further, a choke bush can be affixed into the connecting piece, said choke bush being mounted coaxially to said connecting piece. The choke bush may be made of synthetic material and will in turn have a hole or bore which is considerably smaller than the length-wise bore in the threaded rod. The size of the bore in the choke bush can be so chosen that the pressure equalization between the second chamber and that portion of the intake means which lies behind the throttle valve takes place more slowly than does the increase in pressure in the intake means resulting from the closing of one of the inlet valves of the engine. In a preferred embodiment of the present invention, the internal portions of the housing are so arranged that the threaded rod, the spring means, the reinforcement disc and the collar of synthetic material, as well as the pressure pin, the sealing valve body and the connecting pipe are all mounted coaxially.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
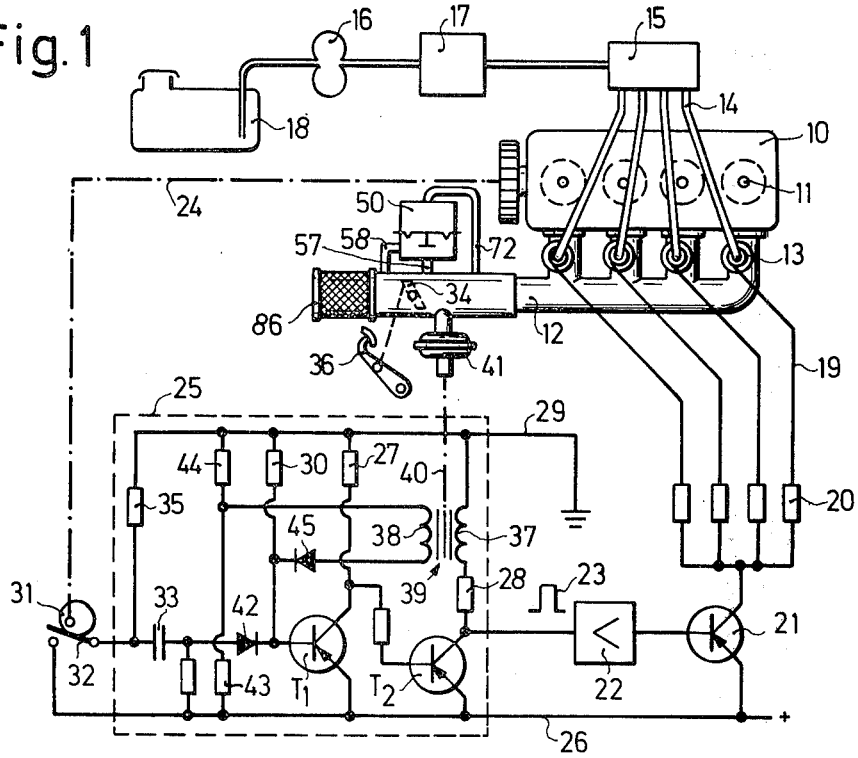
FIG. 1 shows an electrically controlled injection arrangement in a partially schematic representation.

The preferred embodiment of the present invention will now be described with reference to the drawing.

The gasoline injection arrangement shown in FIG. 1 is used to control the operation of a four cylinder combustion engine 10, whose spark plugs 11 are connected to a high voltage spark generating arrangement which is not shown. Positioned closely to the intake valves (not shown) of the combustion engine are four electromagnetically operable injection valves 13, each mounted on one branched connecting piece emanating from the air intake means 12 and leading to the individual cylinders. Fuel is fed to each injection valve via a distributor 15 and fuel lines indicated with reference numeral 14. The fuel is pumped from a fuel tank 18 via an electrically driven pump 16 and is applied to the distributor 15 after passing through a pressure regulator 17. Pressure regulator 17 has the object to keep the pressure of the fuel at each injection valve at a substantially constant value of approximately 2 atm.

Each of the injection valves 13 has a magnetizing winding one of whose ends is connected to ground while the other end is connected via connecting lines 19 to one of four resistors 20. The resistors 20 are connected in common to the collector of a power transistor 21. Rectangular pulses 23 are applied to this transistor via an electronic control arrangement having an transistor amplifier 22. The electronic control arrangement will be further described below. The pulses are applied to said power transistor 21 at each rotation of the cam shaft 24. The injection valves 13 are held open for a time duration corresponding to the widths of these pulses. The quantity of fuel injected is proportional to the time that the injection valve is open. This quantity, of course, must be adjusted to correspond to the particular operating conditions of the engine.

The control circuit 25 which serves to so regulate the injected fuel quantity is shown as 25 in FIG. 1. It consists mainly of a monostable circuit which has a first pnp type transistor T1 and a second pnp transistor T2. The emitters of both transistors are connected via a line 26 with a positive side of a battery which is the battery in the vehicle and has a nominal voltage of 12.6 volts. The connectors of transistors T1 and T2 respectively are connected to a common negative line (ground line) via load resistors 27 and 28 respectively. This ground line is of course connected to the negative terminal of the vehicle battery.

In the quiescent state transistor T1 is kept in the conductive condition by means of resistance 30 which is connected to the negative line 29. At this time transistor T2 is blocked. This corresponds to the stable state of the monostable circuit 25. The unstable state, which determines the length of time for which solenoid valve 13 remains open, that is the length of time for which fuel is injected, is initiated when cam 31 which rotates with cam shaft 24 pushes switch arm 32 against the contact connected to the positive line 26. Normally, the switch is held in the open position by means of a spring. While the contact arm 32 is in the open position, capacitor 33 charges through resistor 35. When contact 32 is closed by cam 31, the negatively charged side of capacitor 33 is connected to the positive line which causes a pulse to be transmitted to the base of transistor T1 which blocks said transistor. Simultaneously transistor T2 becomes conductive, as does power transistor 21 and the solenoid valve 13 opens. After an interval determined by the time constant of the monostable circuit, the solenoid valve again closes when the transistors T1 and T2 return to their original states.

The time at which this switching back occurs depends on the inductivity of a primary winding 37 which is connected in the collector circuit of transistor T2. Primary winding 37, together with secondary winding 38 and a movable iron core 39, form a transformer. The iron core 39 is coupled via a linkage 40 with the membrane of a pressure box 41. This pressure box is arranged to sample the pressure in the air intake pipe immediately behind the throttle valve 34 which is activated by gas pedal 36. The less the pressure in the intake pipe, the smaller the inductivity of the primary winding 37, since the smaller the pressure in the pipe, the further the iron core is moved away from the windings.

One end of secondary winding 38 is connected to a diode 5, which in turn is connected to the base of transistor T1. The other end of winding 38 is connected to the junction point of two resistors, 43 and 44, connected between plus line 26 and minus line 29. As soon as switch arm 32 makes contact, and blocks transistor T1 via diode 42, transistor T2 can furnish current through the primary winding 37. The rate of change of current increase in primary winding 37 is inversely proportionate to the inductivity. It induces a voltage in secondary winding 38 which maintains the transistor T2 in a conductive condition, independent of the position of switch arm 32. The current flow through transistor T2 continues until the current in primary winding 37 is approximately the saturation value. The induced voltage which serves to block transistor T1 via diode 45 becomes smaller and smaller as the primary current approaches the saturation value and finally decreases to such an extend that the negative voltage at the base of transistor T1 furnished via resistances 43 and 44 predominates and causes the transistor to return to its original conductive condition. As soon as this happens, power transistor 21 is blocked and the injection process ended.

The object of the present invention is now to furnish a system whereby the pressure box 41 and its associated pressure transducer, namely the transformer with the above-described changing inductivity, may be used for determining the quantity of fuel to be injected even when the engine is operated under free wheeling conditions. By free wheeling conditions is to be understood all conditions under which the engine is operated at a speed greatly in excess of the idling speed, even though the throttle valve is closed. Such conditions occur, for example, during a downhill run or during the braking of the vehicle. Pressure reduction limiter 50 (see FIG. 1) is used to achieve this purpose.

Figure 2:
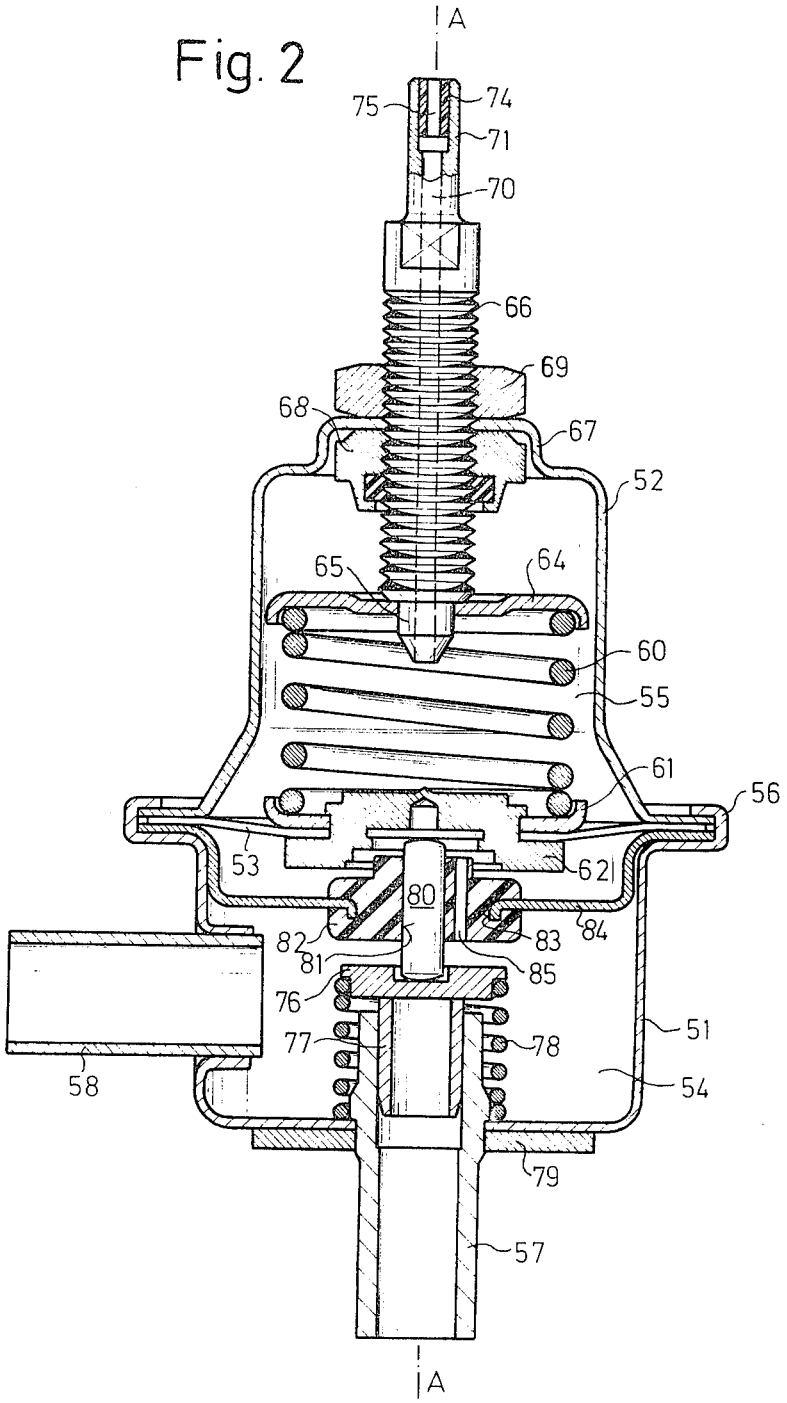
FIG. 2 shows an axial length-wise section of a pressure decrease limiter used in conjunction with the arrangement of FIG. 1.

A preferred embodiment of the pressure reduction limiter is shown in FIG. 2. It comprises a housing having a first section 51 and a second section 52. The housing is divided into a first, lower chamber 54 and a second, upper chamber 55 by means of a membrane 53. Membrane 53 is rigidly held at a flanged edge 56 which joins the two parts of the housing.

A connecting piece 57 extends into lower chamber 54. Connecting piece 57 is arranged in the air intake means 12 behind the throttle valve 34 in the direction of air travel, in the manner shown in FIG. 1. Connecting piece 57 is a part of first connecting means. Air which is to be furnished to the air intake means bypassing the throttle valve enters via a connecting piece 58 (second connecting means) which is soldered into the lower chamber 51 in a direction perpendicular to the longitudinal axis AA of the housing 5. It is connected to the air intake means at a position preceding the throttle valve, as shown in FIG. 1.

A compression spring 60 is mounted in upper chamber 55. This compression spring pushes with one end against the ring target 61. The ring target is situated in the center of membrane 53 and in turn rests against a reinforcing plate 62 which passes through the membrane. The membrane itself may be rubber sheeted webbing. The other end of compression spring 60 pushes against a disc 64 which is fastened to an extension piece 65 of a threaded rod 66. Threaded rod 66 is screwed into a threaded bushing 68 which is affixed to the upper surface of the housing portion 52. By means of threaded rod 66 the pressure of spring 60 can be adjusted so that the arrangement responds to the particular pressure drop at which air is to be admitted to the air intake means through the pressure reduction limiter. The so chosen adjustment can be maintained by means of a lock nut 69. Threaded rod 66 has a longitudinal bore 70 which passes therethrough and terminates in a connecting piece 71 which has a diameter smaller than the rod diameter. A hose or pipe 72 can be fixed over connecting piece 71 for allowing air to pass from the upper chamber 55 into the portion of the air intake pipe 12 which lies behind the throttle valve 34. Since the intake pressure of engine 10 tends to vary rapidly, it is desirable to supply a choke bush 74 made of synthetic material in the end portion of connecting piece 71. Said choke bush 74 has a longitudinal bore whose diameter is smaller than the diameter 70 of threaded rod 66.

The sealing valve means, comprising a plate-shaped valve body 76 are arranged in lower chamber 54. The sealing surface of the valve is to sit on the front edge of a first connecting pipe 77, which front surface has been planed. The first connecting pipe 77 is pressed into the end portion of a connecting piece 57 herein referred to as a second connecting pipe. The end section of connecting piece 57 is surrounded by a spring 78 which presses against the reinforced bottom portion of a ring target 79 mounted in the lower housing portion 51. Spring 78 attempts to move the valve body away from the closed position. In order to be able to transmit the power required for the lifting of the membrane, a pressure pin 80 is connected without play between the reinforcement disc 62 and valve body 76. Pressure pin 80 is movable in a length-wise direction along a path determined by the collar 82 which is made of nylon and is sprayed into a central opening of the rigid partition 84. Rigid partition 84 is made of deep drawn steel plate and has a flange-like edge which, together with membrane 53, is rigidly attached to the flange 56. The main function of this rigid partition is to isolate the system comprising the springs 60 and 78, the masses of the valve body 76, and the threaded rod 81 as well as the reinforcement plate 62 and its tension ring 61 from pressure changes in the intake means. These pressure changes occur mainly at low speeds.

In order that the pressure existing in the lower chamber 54, which is approximately equal to the outside air pressure, may be fully applied to membrane 53, a connection must be furnished between chamber 54 and the volume enclosed by the rigid partition 84. An equalization bore 85 serves this purpose. The diameter of the bore is approximately 1 mm. The bore runs parallel to the longitudinal axis AA of the housing. Threaded rod 66, compression spring 70, reinforcement plate 62, the pressure pin 81 and the valve body 76 are also coaxially arranged. This results in a lack of sensitivity to vibration which of course is required during the operation of the vehicle and further results in a very exact response threshold.

The above-described pressure reduction limiter operates as follows:

When, during operation of the vehicle at high speeds the throttle valve is suddenly closed, the pressure behind the throttle valve drops rapidly to a low value. The pressure in upper chamber 55 reaches the same value within approximately 0.1 second, while in the lower chamber a pressure prevails which is lower than atmospheric pressure by only the small loss in the intake filter 86. As soon as the pressure in the upper chamber 55 has decreased to the threshold value set by the compression spring, which may for example be approximately 300 Torr absolute, the membrane moves. Movement of the membrane and its reinforcing plate 62 against the threaded rod 66 causes spring 78 to lift the valve body from its seat and allows sufficient air to enter through the first chamber and via the connecting piece 57 into the air intake means behind the throttle valve that enough combustion takes place within the engine so that it is not excessively cooled.

Figure 3:
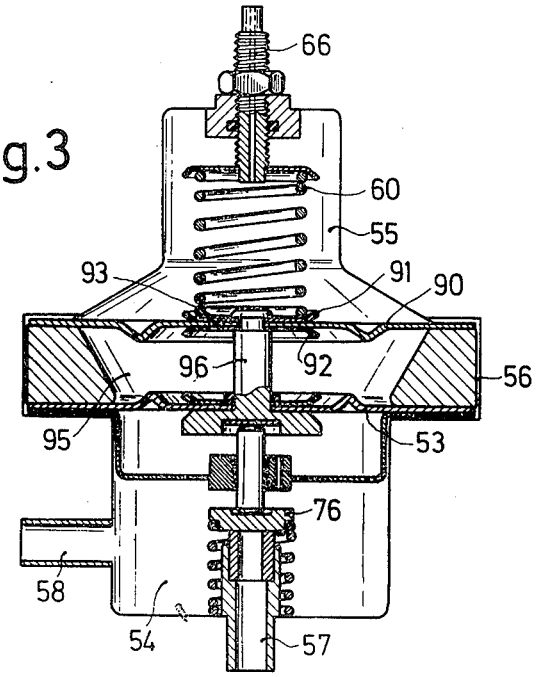
FIG. 3 shows an alternate embodiment of the pressure reduction limiter of FIG. 2.

A second embodiment of the present invention is shown in FIG. 3 in schematic form. The same or similar parts in FIG. 3 as those in FIG. 2 have the same reference numerals as in FIG. 2. This embodiment differs from that shown in FIG. 2 mainly in that a second membrane 90 is provided whose effective diameter is larger than that of the first membrane 53. The central area of second membrane 90 is reinforced with two tin plates 91 and 92. This central zone has a choke bore 93 which connects the upper chamber 55 with the intermediate chamber 95 which is formed by the second membrane. Both membranes are separated by a fixed distance at the center via a pin 96. In the quiesent condition wherein the engine runs with unchanging loads and throttle valve opening, the pressure in the upper chamber 55 and that in the intermediate chamber 95 is equal. The power exerted by spring 60 against second membrane 90 is opposed by a force which is equal to the product of the effective surface of the first membrane 53 and the pressure difference between chamber 95 and the lower chamber 54. The opening pressure of the valve can be adjusted by means of the pressure of spring 60 with the aid of threaded rod 66 in such a manner that it is less than the pressure in the engine under conditions of free wheeling operation.

In the dynamic operation, wherein a rapid closing of the throttle valve causes an equally rapid drop in the air intake pipe portion following the throttle valve, the resulting low pressure first acts only on membrane 90 whose effective surface is larger than that of membrane 53. Thereby the sealing valve 76 can be opened more rapidly. Bore 93 then serves to equalize the pressure in the intermediate chamber 95 with the upper chamber 55. The time constant required for this equalization depends both on the size of the volume of intermediate chamber 95 and the diameter of choke bore 93. In this fashion sealing valve 76 can be made to open during a free wheeling operation in response to a pressure which exceeds the pressure in the combustion engine under no load conditions.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

We claim:

1. In a combustion engine having air intake means, throttle valve means having a closed position blocking air from said intake means, whereby sudden closure of said throttle valve means causes a sudden pressure drop in said air intake means, and fuel injection means for injecting quantities of fuel varying as a function of air volume or pressure in said air intake means during each operating cycle of said engine, a pressure reduction limiter responsive to said pressure drop in said air intake means and furnishing a quantity of air sufficient for maintaining combustion in said engine to said air intake means following said closure of said throttle valve means, said pressure reduction limiter comprising a housing; membrane means for dividing said housing into a first and second chamber, said membrane means including reinforcement means for reinforcing said membrane means, said reinforcement means comprising a reinforcement disc having a first surface facing said first chamber; ring target means connected to said reinforcement means; first spring means for applying tension to said membrane means, said first spring means having a first end in operative contact with said ring target means; first connecting means for connecting said first chamber to said air intake means in a position following said throttle valve means in the direction of air flow; second connecting means for connecting said first chamber to said air intake means prior to said throttle valve means in said direction of said air flow; sealing valve means braced against said membrane means, said sealing valve means having a closed position for blocking air flow from said first chamber to said air intake means; a rigid partition positioned between said sealing valve means and said membrane means, said rigid partition having a collar of synthetic material sprayed into a hole in said partition, said collar surrounding a bore; a pressure pin mounted through said bore, said pressure pin having a first end portion in contact with said reinforcement disc and a second end portion in contact with said sealing valve means, said pressure pin being movable in a lengthwise direction through said bore in said rigid partition, and third connecting means for connecting said second chamber to said air intake means following said throttle valve means in the direction of said air flow, said third connecting means comprising a connector having a choke bore.

2. In a combustion engine having air intake means, throttle valve means having a closed position blocking air from said intake means, whereby sudden closure of said throttle valve means causes a sudden pressure drop in said air intake means, and fuel injection means for injecting quantities of fuel varying as a function of air volume or pressure in said air intake means during each operating cycle of said engine, a pressure reduction limiter responsive to said pressure drop in said air intake means and furnishing a quantity of air sufficient for maintaining combustion in said engine to said air intake means following said closure of said throttle valve means, said pressure reduction limiter comprising a housing; membrane means for dividing said housing into a first and second chamber, said membrane means including reinforcement means for reinforcing said membrane means, said reinforcement means comprising a reinforcement disc having a first surface facing said first chamber; ring target means connected to said reinforcement means; first spring means for applying tension to said membrane means, said first spring means having a first end in operative contact with said ring target; first connecting means for connecting said first chamber to said air intake means in a position following said throttle valve means in the direction of air flow; second connecting means for connecting said first chamber to said air intake means prior to said throttle valve means in said direction of said air flow; sealing valve means braced against said membrane means, said sealing valve means having a closed position for blocking air flow from said first chamber to said air intake means; a rigid partition positioned between said sealing valve means and said membrane means, said rigid partition having a collar of synthetic material pressed into a hole in said partition, said collar surrounding a bore; a pressure pin mounted through said bore, said pressure pin having a first end portion in contact with said reinforcement disc and a second end portion is contact with said sealing valve means, said pressure pin being movable in a lengthwise direction through said bore in said rigid partition; and third connecting means for connecting said second chamber to said air intake means following said throttle valve means is the direction of said air flow, said third connecting means comprising a connector having a choke bore.

3. A pressure reduction limiter as set forth in claim 2, wherein said rigid partition means comprise a deep drawn sheet metal partition.

4. A pressure reduction limiter as set forth in claim 3, wherein said first connecting means comprise a first connecting pipe having a front surface in said first chamber; and wherein said sealing valve means comprise a plate-shaped valve body having a sealing surface for contacting said front surface of said first connecting pipe.

5. A pressure reduction limiter as set forth in claim 4, wherein said first connecting means further comprise a second connecting pipe having an end section holding said first connecting pipe, said second connecting pipe means connecting said first chamber to said air intake means.

6. In a combustion engine having an air intake means, throttle valve means having a closed position blocking air from said intake means, whereby sudden closure of said throttle valve means causes a sudden pressure drop in said air intake means, and fuel injection means for injecting quantities of fuel varying as a function of air volume or pressure in said air intake means during each operating cycle of said engine, a pressure reduction limiter responsive to said pressure drop in said air intake means and furnishing a quantity of air sufficient for maintaining combustion in said engine to said air intake means following said closure of said throttle valve means, said pressure reduction limiter comprising a housing; membrane means dividing said housing into a first and a second chamber; first connecting means connecting said first chamber to said air intake means in a position following said throttle valve means in the direction of air flow, said first connecting means comprising a first connecting pipe having a front surface in said first chamber; second connecting means for connecting said first chamber to said air intake means prior to said throttle valve means in said direction of said air flow, sealing valve means braced against said membrane means, said sealing valve means having a closed position for blocking air flow from said first chamber to said air intake means, said sealing valve means comprising a plate-shaped valve body having a first sealing surface for contacting said front surface of said first connecting pipe; spring means mounted around said first connecting pipe for moving said sealing valve means to the open position thereof; a rigid partition having a narrow open passage, positioned between said sealing valve means and said membrane means; and third connecting means connecting said second chamber to said air intake means following said throttle valve means in the direction of air flow, said third connecting means comprising a connecting piece having a choke bore, wherein third connecting means comprise threaded rod means having an axial bore, said threaded rod means having a first end section within said second chamber, said first end section constituting an abutment for said spring means, said threaded rod means further having a second end section, said second end section being provided with said connecting piece.

7. A pressure reduction limiter as set forth in claim 6, further comprising additional spring means for applying tension to said membrane means.

8. A pressure reduction limiter as set forth in claim 7, further comprising reinforcement means in said membrane means; ring target means connected to said reinforcement means; and wherein said first spring means has a additional end in operative contact with said ring target.

9. A pressure reduction limiter as set forth in claim 8, wherein said reinforcement means comprise a reinforcement disc having a first surface facing said first chamber; wherein said rigid partition means has a bore; further comprising pressure pin means mounted through said bore, said pressure pin means having a first end portion in contact with said reinforcement disc and a second end portion in contact with said sealing valve means, said pressure pin means being movable in a length-wise direction through said bore in said rigid partition means.

10. A pressure reduction limiter as set forth in claim 9, wherein said rigid partition means has a collar arranged in the central portion thereof, said collar having said bore.

11. A pressure reduction limiter as set forth in claim 10, wherein said rigid partition means further has a second bore narrower than said first bore, for constituting a air passage.

12. A pressure reduction limiter as set forth in claim 6, further comprising throttle bush means mounted in said connecting piece of said threaded means.

* * * * *